US005779507A

United States Patent [19]

Yeh

[11] Patent Number: 5,779,507

[45] Date of Patent: Jul. 14, 1998

[54] TERMINAL DEVICE FOR INTERFACE SOCKETS

[76] Inventor: Te-Hsin Yeh, No. 45, Tong Yuan Road, Chungli City, Taoyuan County, Taiwan

[21] Appl. No.: 695,198

[22] Filed: Aug. 1, 1996

Related U.S. Application Data

[63] Continuation-in-part of Ser. No. 440,588, May 15, 1995, abandoned.

[51] Int. Cl.[6] ..... H01R 23/70

[52] U.S. Cl. ..... 439/862; 439/637; 439/885

[58] Field of Search ..... 439/71, 444, 630, 439/631, 634, 636, 857, 862, 885, 637

[56] References Cited

U.S. PATENT DOCUMENTS

| | | | |
|---|---|---|---|
| 4,370,017 | 1/1983 | Grabbe et al. | 439/862 |
| 4,891,023 | 1/1990 | Lopata | 439/637 |
| 5,387,133 | 2/1995 | Tondreault et al. | 439/862 X |
| 5,425,658 | 6/1995 | White | 439/637 |
| 5,620,342 | 4/1997 | Kinross | 439/637 |

*Primary Examiner*—Neil Abrams
*Assistant Examiner*—Katrina Davis
*Attorney, Agent, or Firm*—Jordan and Hamburg

[57] ABSTRACT

A terminal device has right and left terminals adjacent one another and punched from a conductive sheet. The right and left terminals are connected to a common positioning strip and all are planar and lie in a common plane. Each of the right and left terminals have inner and outer insert posts, connected at first ends to the positioning strip, a mounting plate portion connected at a lower edge thereof to second ends of the inner and outer insert posts, and a contact member extending from an upper edge of the mounting plate portion. The contact members each have a biasing ring connecting a contact portion to the upper edge of the mounting plate portion. The biasing ring biases the contact portion into a reception channel between the right and left terminals to make electrical contact with a corresponding mating connector terminal.

9 Claims, 3 Drawing Sheets

TERMINAL DEVICE FOR INTERFACE SOCKETS

This application is a continuation-in-part of application Ser. No. 08/440,588 filed May 15, 1995 and now abandoned.

BACKGROUND OF THE INVENTION

The present invention relates generally to an improved terminal device for use in interface sockets, and more particularly to a terminal set having a planar profile and a left terminal and a right terminal, which is preferably manufactured by punching in a simple manner.

The conventional terminal device is substantially as that shown in FIGS. 1A and 1B. A conventional terminal 1 is formed from a metal strip of a suitable width. An upper section of the terminal 1 bends downwardly to form a contact portion 2 of a suitable flexibility, while a lower portion thereof forms a bent post 3. A series of the terminals 1 are arranged in a row on an upper end of a conductive sheet 4. Since the contact portions of the respective terminals 1 are oriented in a common direction, when the row of terminals 1 is placed at an upper side of a left socket orifice or a right socket orifice of an interface socket in a longitudinal manner with the bent contact portions 2 oriented in the direction of the inner side of the left socket orifice, the series of terminals 1 is fixedly disposed in the interface socket.

The conventional terminal device as described above is widely used. But it has several drawbacks. Since the above-mentioned terminal device has to be arranged in a longitudinal manner, under the circumstances that each of the orifices of the interface socket must be provided with terminals, if any of the series of terminals 1 bends or falls off, and the length of the remaining series of terminals is shorter than that of the interface socket, the remaining terminals become unusable material, and hence the amount of waste terminal material is quite considerable. Furthermore, since the bent contact portions of the conventional terminal device stick out from one side of the series of terminals, packing and storage of the terminal devices are difficult. Moreover, the contact portions may easily fall off or be damaged due to improper handling, rendering the whole series of terminals unusable. In addition, the structure of the conventional terminal is comparatively complicated because the contact portions and the bent posts have to be pre-bent into the desired shape, increasing manufacturing costs.

SUMMARY OF THE INVENTION

A primary object of the present invention is to provide an improved terminal device for interface sockets, which consists of terminal sets having a planar profile and are preferably manufactured by punching. Each terminal set consists of a left terminal and a right terminal. The respective contact portions of the left terminal and the right terminals oppose each other, so that when the left terminal and the right terminal are simultaneously fitted into the corresponding left socket orifice and right socket orifice of the interface socket in a horizontal manner, the opposed contact portions extend into a central groove of the interface socket.

Another object of the present invention is to provide an improved terminal device for interface sockets, which includes terminal sets having a planar profile which are easily manufactured by punching, which allow the terminal device to be easily packed and stored. Additionally, the terminal device has a planar profile without any part thereof sticking out, thereby reducing the possibility of bending or breaking off of the terminals due to improper handling.

Still another object of the present invention is to provide an improved terminal device for interface sockets, which includes terminal sets having a planar profile and which are easily manufactured by punching, wherein each terminal set has a left terminal and a right terminal. By means of inserting the terminal device horizontally into the left and right socket orifices of the interface socket one set at a time, the amount of terminal waste material can be significantly reduced.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1A:
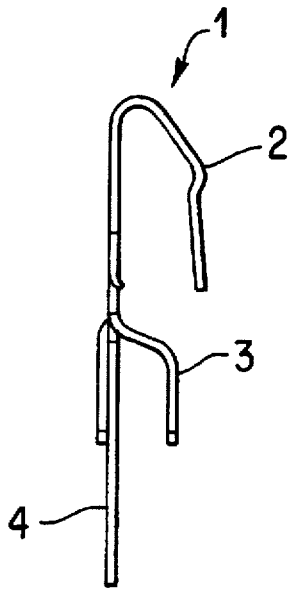
FIG. 1A PRIOR ART
FIG. 1A is a side view of a conventional terminal.
Figure 1B:
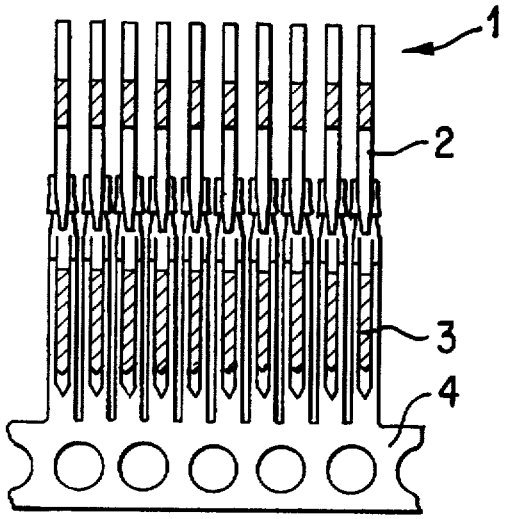
FIG. 1B PRIOR ART
FIG. 1B is a front view of a series of the conventional terminals shown in FIG. 1A arranged in a row.
Figure 2:
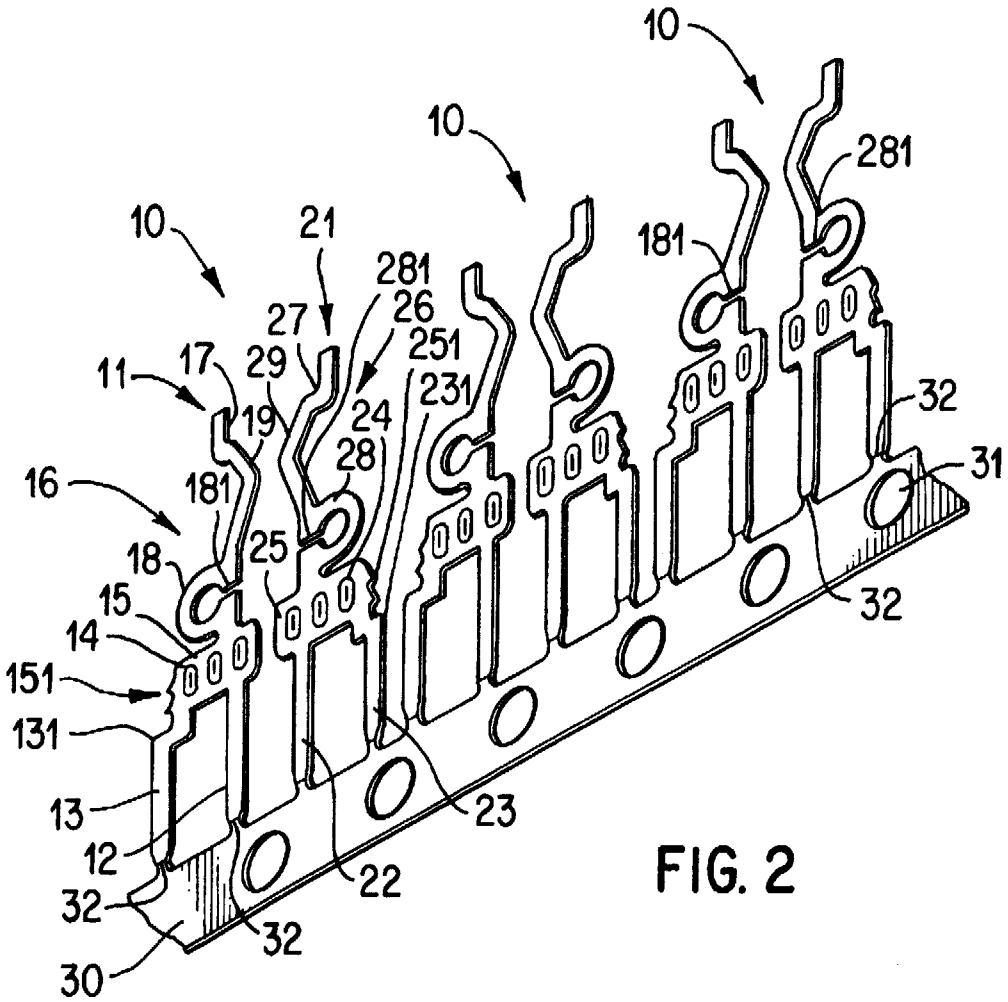
FIG. 2 is a perspective view of a terminal device according to the present invention.
Figure 3:
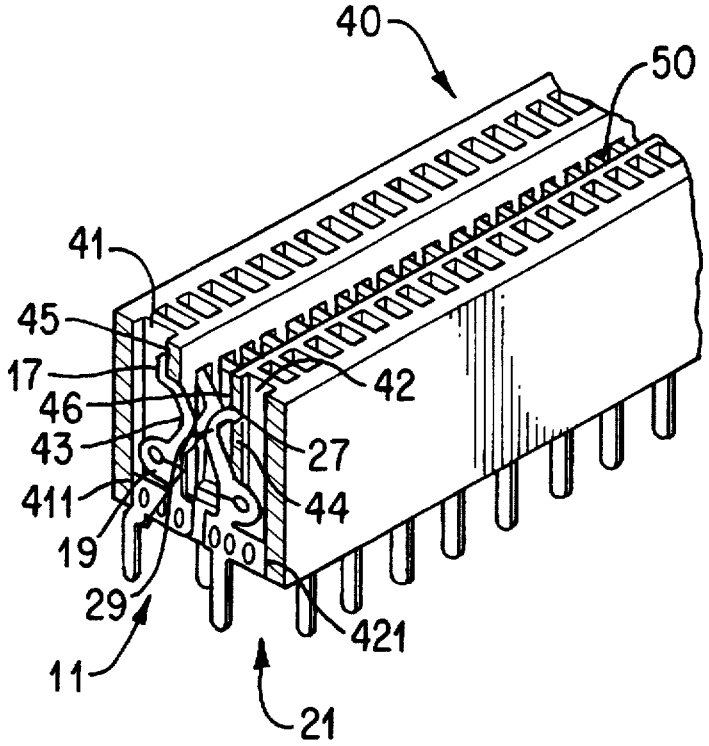
FIG. 3 is a perspective sectional view of the terminal device of the present invention shown in FIG. 2 fixedly installed in an interface socket.

With reference to FIGS. 2 and 3, the improved terminal device for use in interface sockets includes a plurality of terminal sets 10 equally spaced apart and fixedly connected to a conductive sheet 30. The terminal sets 10 and the conductive sheet 30 are integrally punched from an elongated metal sheet. The conductive sheet 30 is provided with a plurality of positioning holes 31 equally spaced apart for reducing the overall weight of the terminal device and facilitating automatic assembly. Additionally, breaking lines 32 are provided at joints between the conductive sheet and the terminal sets 10 so that, after the terminal sets are fixedly inserted in an interface socket 20, the conductive sheet 40 and the terminal sets 10 can be separated.

Each terminal set 10 includes a left terminal 11 and a right terminal 21 which are symmetrical in shape and have a common substantially planar profile. The left terminal 11 and the right terminal 21 are respectively provided with inner and outer insert posts 12, 13 and 22, 23 which are respectively connected to the conductive sheet 30 via the breaking lines 32. The posts 12 and 13 are connected to one end of a fixed mounting plate 15 of the right terminal 11, while posts 22 and 23 are connected to one end of a fixed mounting plate 25 of the left terminal 21. The fixed mounting plates 15 and 25 respectively have bulges 14 and 24 on a surface thereof. The arrangement of such bulges 14 and 24 provides a lateral abutting function when the terminal sets 10 are inserted into respective left and right socket orifices 41 and 42 of the interface socket 40. In addition, the fixed mounting plates 15 and 25 are respectively provided with outwardly extending lap sheets 16, 26 at the other end thereof. The lap sheets 16, 26 respectively have retaining members 17, 27 at an extreme end thereof. The lap sheets 16, 26 further have biasing rings 18, 28 located at an appropriate position at an outer side thereof. The middle of the lap sheets 16, 26 are respectively provided with corresponding contact portions 19, 29 which bend suitably inwardly. Therefore, when each terminal set 10 is inserted with the lap sheets 16, 26 occupying the corresponding left and right socket orifices 41, 42 of the interface socket 40, the contact portions 19, 29 of the left and right terminals 11, 21 extend through elongated slots 43 and 44, located in inner sides of the left and right socket orifices 41 and 42, into a groove 50 formed in a central portion of the interface socket 40. At the same time, the retaining members 17, 27 at the respective extreme ends of the lap sheets 16, 26 are checked by corresponding baffle strips 45, 46 located at upper edges of the inner sides of the left and right socket orifices 41, 42. Then the terminal set 10 is separated from the conductive sheet 30 along the breaking lines 32, facilitating assembly of the terminal set 10. Additionally, before the left and right terminals 11 and 12 of each terminal set 10 are inserted into the left and right socket orifices 41 and 42 of the interface socket 40, the inner insert post 12 of the left terminal 11 and the outer insert post 23 of the right terminal 21 (or the outer insert post 13 of the left terminal 11 and the inner insert post 22 of the right terminal 21) are cut off by means of a particular assembly machine (not shown), so that after the left and right terminals 11 and 21 are fitted into the corresponding left and right socket orifices 41 and 42 of the interface socket 40, there remain only two insert posts, as shown in FIG. 3.

Furthermore, the outer insert posts 13 and 23 of the left and right terminals 11 and 21 are optionally provided with outwardly stepped positioning portions 131 and 231 adjacent the fixed mounting plates 15 and 25 for limited travel of the the terminal set 10 when inserted into the left and right socket orifices 41 and 42 of the interface socket 40.

The contact portions 19 and 29 protrude into the groove 50 of the interface socket 40 in order to engage a mating connector (not shown) which is inserted into the groove 50. The biasing rings 18 and 28 respectively have slits 181 and 281 which permit deflection of the biasing rings 18 and 28 when the mating connector is inserted in the groove 50 and the contact portions 19 and 29 are forced back into their respective socket orifices 41 and 42 as required to accept the mating connector. In order to maintain proper contact pressure, the contact portions 19 and 29 are biased toward the groove 50 and against the mating connector by the biasing rings 18 and 28. Insertion of the mating connector applies stress to the biasing rings 18 and 28 which elastically deforms the biasing rings 18 and 28 causing the slits 181 and 281 to open. Thus, the elastic deformation of the biasing rings 18 and 28 acts to bias the contact portions 19 and 29 in electrical contact with corresponding terminals of the mating connector. It is further noted that in the preferred embodiment, the biasing rings 18 and 28 serve to bias the retaining members 17 and 27 against respective ones of the baffle strips 45 and 46. The biasing of the retaining members 17 and 27 against the baffle strips 45 and 46 ensures uniform alignment of the contact portions 19 and 29 in the groove 50 and presents the contact portions 19 and 29 to the mating connector in a pre-biased state whereby the initial bias force of the contact portions 19 and 29 against the mating connector can be controlled. It is realized that the retaining members 17 and 27 may be omitted where formation of the biasing rings 18 and 28 and the contact portions 19 and 29 is sufficiently controlled to maintain adequate alignment and biasing of the contact portions 19 and 29.

In order to secure the terminal sets 10 in the interface socket 40, the outer edges of the fixed mounting plates 15 and 25 of the left and right terminals 11 and 21 are further provided with hooks 151 and 251 which engage corresponding notches 411 and 421 of the left and right socket orifices 41 and 42 of the interface socket 40.

With reference to the array of terminal sets shown in FIG. 2, since the terminal sets 10 are horizontally inserted into the left and right socket orifices 41 and 42 of the interface socket 40 one set at a time, if any terminal set 10 is damaged or fallen off, it is not necessary to discard the whole array of terminal sets 10, eliminating the problem of undue waste of terminals.

Since the interface socket 40 is generally provided with a multiplicity of orifices, when a specific machine (not shown) is used to mount a plurality of terminal sets 10 above the corresponding orifices in the interface socket 40, and cut off unwanted inserted posts of the terminals so that the outer insert post 13 of the left terminal 11 and the outer insert post 22 of the right terminal 21 of one terminal set 10 remain, while the inner insert post 12 of the left terminal 11 and the outer insert post 23 of the right terminal 21 of the adjacent terminal set 10 remain, the insert posts are alternately arranged in the way shown in FIG. 3 when a plurality of such terminal sets 10 are simultaneously inserted into the interface socket 40. If, after a plurality of terminal sets 10 are fitted into some of the orifices of the interface socket 40, the interface socket 40 may be removed to the assembly machine for insertion in the orifices thereof other sets of terminals.

In addition, because the terminal sets 10 have a substantially planar profile, the terminal device according to the present invention is simple and less costly to manufacture, and the problem of damaging the terminals during production and assembly is reduced. Moreover, the terminal sets may be horizontally inserted into the corresponding orifices of the interface socket one set at a time to effectively reduce undue waste of terminals as in the conventional art.

Although the present invention has been illustrated and described with reference to the preferred embodiment thereof, it should be understood that it is in no way limited to the details of such embodiment but is capable of numerous modifications within the scope of the appended claims.

What is claimed is:

1. A terminal device for use in an interface socket defining rows of right and left orifices, opening to a bottom surface of said interface socket, and a groove interposed therebetween with the right and left orifices each having elongated slots in an inner wall thereof communicating with said groove, said terminal device comprising:

terminal sets connected to a conductive sheet, the terminal sets and the conductive sheet being integrally punched from an elongated sheet of metal;

said conductive sheet being provided with a plurality of positioning holes facilitating automatic assembly;

each of said terminal sets including corresponding left and right terminals adjacent one another with inner edges facing each other and defining a reception channel therebetween for receipt of a mating connector, said right and left terminals being symmetrical with respect to each other in shape and having a common substantially planar configuration;

said left terminal and said right terminal each having:

a mounting plate portion having an outer insert post and an inner insert post extending from a lower edge thereof, the inner insert post being joined to said mounting plate proximate an inner edge of said mounting plate portion and the outer insert post being joined to said mounting plate proximate an outer edge thereof;

each of said outer insert post and said inner insert post having a distal end connected to said conductive sheet via a frangible interface; and said mounting plate portion having a contact member extending from an upper edge of the mounting plate portion;

each of said contact members having a biasing ring connected to said upper edge of said mounting plate portion at a first position on said biasing ring;

each of said contact members further having a contact portion extending from a second position on said biasing ring;

said biasing ring having a slit disposed in a shorter arc of two arcs of said biasing ring defined between said first and second positions and extending from an inner circumference of said biasing ring to an outer circumference of said biasing ring to permit elastic deflection of said biasing ring for biasing said contact portion into said reception channel; and said contact portion extending inwardly at a middle section thereof into said reception channel between said right and left terminals such that said contact portions of the respective left and right terminals extend through corresponding ones of said elongated slots into said groove of said interface socket when said right and left terminals are inserted into corresponding ones of said right and left orifices in said interface socket.

2. The terminal device as claimed in claim 1, wherein one of the inner insert post and the outer insert post of said left terminal and another one of the outer insert post and inner insert post of said right terminal are removed.

3. The terminal device as claimed in claim 1, further comprising each of said right and left terminals having a positioning portion stepped outwardly from said outer edge of said mounting plate portion and disposed at a juncture between the outer insert posts and said mounting plate portions for limiting travel of the terminal set during insertion into the orifices of the interface socket.

4. The terminal device as claimed in claim 1, further comprising each of said mounting plate portions having a hook portion for engaging corresponding notches of the left and right orifices of the interface socket for retaining the terminal set inserted therein.

5. The terminal device according to claim 1 wherein said elongated slots of said interface connector are bounded on an upper edge thereof by baffle strips, the terminal device further comprising each of said contact members having a retaining member extending from a distal end of said contact portion such that said retaining member engages corresponding ones of said baffle strips on the inner side of said left and right orifices.

6. The terminal device as claimed in claim 5, further comprising each of said mounting plate portions having a hook portion for engaging corresponding notches of the left and right orifices of the interface socket for retaining the terminal set inserted therein.

7. The terminal device as claimed in claim 3, further comprising each of said mounting plate portions having a hook portion for engaging corresponding notches of the left and right orifices of the interface socket for retaining the terminal set inserted therein.

8. An electrical contact terminal device for making an electrical connection with an opposing electrical contact comprising:

a mounting plate portion having a contact member extending from an upper edge of the mounting plate portion;

said contact member having a biasing ring connected to said upper edge of said mounting plate portion at a first position on said biasing ring;

said contact member having a contact portion extending upward from a second position on said biasing ring; and said biasing ring defining a slit disposed in a shorter arc of two arcs of said biasing ring defined between said first and second positions and extending from an inner circumference of said biasing ring to an outer circumference of said biasing ring to permit elastic deflection of said biasing ring for biasing said contact portion into engagement with said opposing electrical contact.

9. A terminal device for use in an interface socket defining rows of right and left orifices, opening to a bottom surface of said interface socket, and a groove interposed therebetween with the right and left orifices each having elongated slots in an inner wall thereof communicating with said groove, said terminal device comprising:

terminal sets connected to a conductive sheet, the terminal sets and the conductive sheet being integrally punched from an elongated sheet of metal;

each of said terminal sets including corresponding left and right terminals adjacent one another with inner edges facing each other and defining a reception channel therebetween for receipt of a mating connector, said right and left terminals being symmetrical with respect to each other in shape and having a common substantially planar configuration;

said left terminal and said right terminal each having a mounting plate portion having a contact member extending from an upper edge of the mounting plate portion;

each of said contact members having a biasing ring connected to said upper edge of said mounting plate portion at a first position on said biasing ring;

each of said contact members further having a contact portion extending from a second position on said biasing ring;

said biasing ring having a slit disposed in a shorter arc of two arcs of said biasing ring defined between said first and second positions and extending from an inner circumference of said biasing ring to an outer circumference of said biasing ring to permit elastic deflection of said biasing ring for biasing said contact portion into said reception channel; and said contact portion extending inwardly at a middle section thereof into said reception channel between said right and left terminals such that said contact portions of the respective left and right terminals extend through corresponding ones of said elongated slots into said groove of said interface socket when said right and left terminals are inserted into corresponding ones of said right and left orifices in said interface socket.

* * * * *